US006322291B1

(12) United States Patent
Rainey

(10) Patent No.: US 6,322,291 B1
(45) Date of Patent: Nov. 27, 2001

(54) REINFORCEMENT MEMBER RETAINING SYSTEM

(75) Inventor: Thomas L. Rainey, Acworth, GA (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 09/579,071

(22) Filed: May 25, 2000

Related U.S. Application Data

(62) Division of application No. 09/049,627, filed on Mar. 27, 1998.

(51) Int. Cl.[7] ..... E04C 2/04; F16B 13/00
(52) U.S. Cl. ..... 405/262; 52/605; 405/284
(58) Field of Search ..... 405/284, 285, 405/286, 262; 52/603–605, 607

(56) References Cited

U.S. PATENT DOCUMENTS 4,116,010 * 9/1978 Vidal ..... 405/262
4,824,293 * 4/1989 Brown et al. ..... 405/284
5,417,523 * 5/1995 Scales ..... 405/284
5,511,910 * 4/1996 Scales ..... 405/262
5,540,525 * 7/1996 Miller et al. ..... 405/284
6,224,295 5/2001 Price et al. ..... 405/262

* cited by examiner

*Primary Examiner*—David Bagnell
*Assistant Examiner*—Tara L. Mayo
(74) *Attorney, Agent, or Firm*—Thomas, Kayden, Horstemeyer & Risley, LLP

(57) ABSTRACT

A modular earth retaining wall system comprising a plurality of similarly configured wall blocks that have lock channels and lock flanges that provide a locking mechanism for resisting leaning or toppling of the blocks. A positive retaining mechanism is also provided for attaching reinforcement fabrics to the retaining wall in between mating courses of wall blocks. This mechanism secures the reinforcement fabrics in place and permits the fabrics to extend along the entire contact area between adjacent stacked wall blocks to avoid an aggregate leaning effect. The retaining mechanism includes a retaining bar that is placed on top of the reinforcement fabric within the lock channel. The retaining bar holds the fabric against a wall of the lock channel in response to tensile loads applied to the fabric to prevent it from being pulled out of the retaining wall.

31 Claims, 6 Drawing Sheets

REINFORCEMENT MEMBER RETAINING SYSTEM

CROSS-REFERENCE TO RELATED APPLICATION

The present application is a Divisional of the filing date of U.S. patent application Ser. No. 09/049,627, filed Mar. 27, 1998.

FIELD OF THE INVENTION

The invention relates generally to earth retaining walls. More particularly, the invention relates to a modular retaining wall system composed of a plurality of wall blocks that are provided with locking means for precluding forward leaning or tipping of the blocks. Further, the invention pertains to retaining means for attaching reinforcement members to the retaining wall in between mating courses of wall blocks formed in the retaining wall.

BACKGROUND OF THE INVENTION

Modular earth retaining walls are commonly used for architectural and site development applications. Such walls are subjected to very high pressures exerted by lateral movements of the soil, temperature and shrinkage effects, and seismic loads. Therefore, the backfill soil typically must be braced with tensile reinforcement members. Usually, elongated structures, commonly referred to as geogrids or reinforcement fabrics, are used to provide this reinforcement. Geogrids are often configured in a lattice arrangement and are constructed of a metal or polymer while, reinforcement fabrics are constructed of a woven or nonwoven polymer fiber. These reinforcement members typically extend rearwardly from the wall and into the soil to stabilize the soil against movement and thereby create a more stable soil mass which results in a more structurally secure retaining wall.

Although several different forms of reinforcement members have been developed, difficulties remain with respect to attachment of the members to retaining walls. In particular, the reinforcement members can shift out of position and be pulled out from the retaining wall due to movement of the soil. This difficulty can be especially problematic in areas of high seismic activity. In response to this problem, several current retaining wall systems have been developed to retain geogrid reinforcement members. Rake shaped connector bars are transversely positioned in the center of the contact area between adjacent stacked blocks with the prongs of the connector bar extending through elongated apertures provided in the geogrid to retain it in place. Despite adequately holding the geogrid in position under normal conditions, this system of attachment provides a substantial drawback. Specifically, the geogrids of the system only extend along the back halves of the contact areas between the blocks. Although the geogrids are relatively thin, this partial insertion of the geogrids can cause the retaining wall to bow outwardly due to the aggregate thickness of the geogrids. As can be appreciated, this outward bowing can be substantial with tall retaining walls that require a multiplicity of geogrids. Aside from creating the impression of instability, this condition increases the likelihood of wall failure, particularly in response to seismic activity.

Another problem associated with the construction of modular retaining walls is securement of the blocks to each other within the wall. Various connection methods are currently used in retaining wall construction to interlock the blocks. In one known system, blocks having bores inwardly extending within their top and bottom surfaces are provided for the receipt of dowels or pins. In addition to limiting shifting of the blocks, these pins are used to retain geogrids. Where a geogrid is to be inserted between two courses of stacked blocks, the pins are inserted into the bores with the pins extending through the apertures of the geogrid. Although providing some resistance against block shifting, the actual strength of the block-to-block connection is generated by the friction between the block surfaces. Therefore, shifting can occur. Moreover, the pins do not lock the upper blocks to the lower blocks. Accordingly, severe seismic activity can cause the upper blocks to jump from their foundations and topple downward. Additionally, when the pins are made of metal, they will corrode over time due to the infiltration of moisture from the surrounding environment.

In another known retaining wall, an upper surface of the blocks includes a projection and a lower surface of the blocks includes a cavity into which the projection can extend. Although the provision of these projections and cavities avoids the corrosion problem associated with the pins of the previously described system, similar to that system, no positive locking mechanism is provided to retain the upper blocks on top of the lower blocks. Therefore, this system is susceptible to toppling in response to strong seismic activity. In addition, construction of the walls is complicated by the fact that the top course of blocks must be held in place when the backfill soil is poured to prevent the blocks from being pushed over the edge of the wall.

It can therefore be appreciated that there exists a need for a mechanically stabilized wall system having secure retaining means for maintaining reinforcement members in their proper positions within the wall. Accordingly, it is to the provision of such an improved mechanically stabilized retaining wall system that the present invention is directed.

SUMMARY OF THE INVENTION

The present disclosure relates to a mechanically stabilized wall system which includes a reinforcement member retaining system which includes an elongated retaining bar for securing a reinforcement member to the retaining wall which is comprised of a plurality of retaining wall blocks having transverse channels which align to form an elongated channel when the blocks are arranged in a course of the retaining wall. Generally speaking, the retaining bar comprises a top surface, a bottom surface formed opposite the top surface, a front surface, and a rear surface formed opposite the front surface, wherein the retaining bar is sized and configured to have a width dimension that is greater than the width of an opening of the elongated channel but smaller than the width dimension of a base of the elongated channel such that when the retaining bar has been inserted into the elongated channel over the reinforcement member, the retaining bar clamps the reinforcement member within the elongated channel when a tensile force is applied to the reinforcement member.

In one embodiment, the retaining bar comprises a substantially planar top surface, a bottom surface formed opposite the top surface, a front surface extending substantially perpendicularly downward from the top surface, and a rear surface extending obliquely from the top surface.

The features and advantages of this invention will become apparent upon reading the following specification, when taken in conjunction with the accompanying drawings.

DETAILED DESCRIPTION

Figure 1:
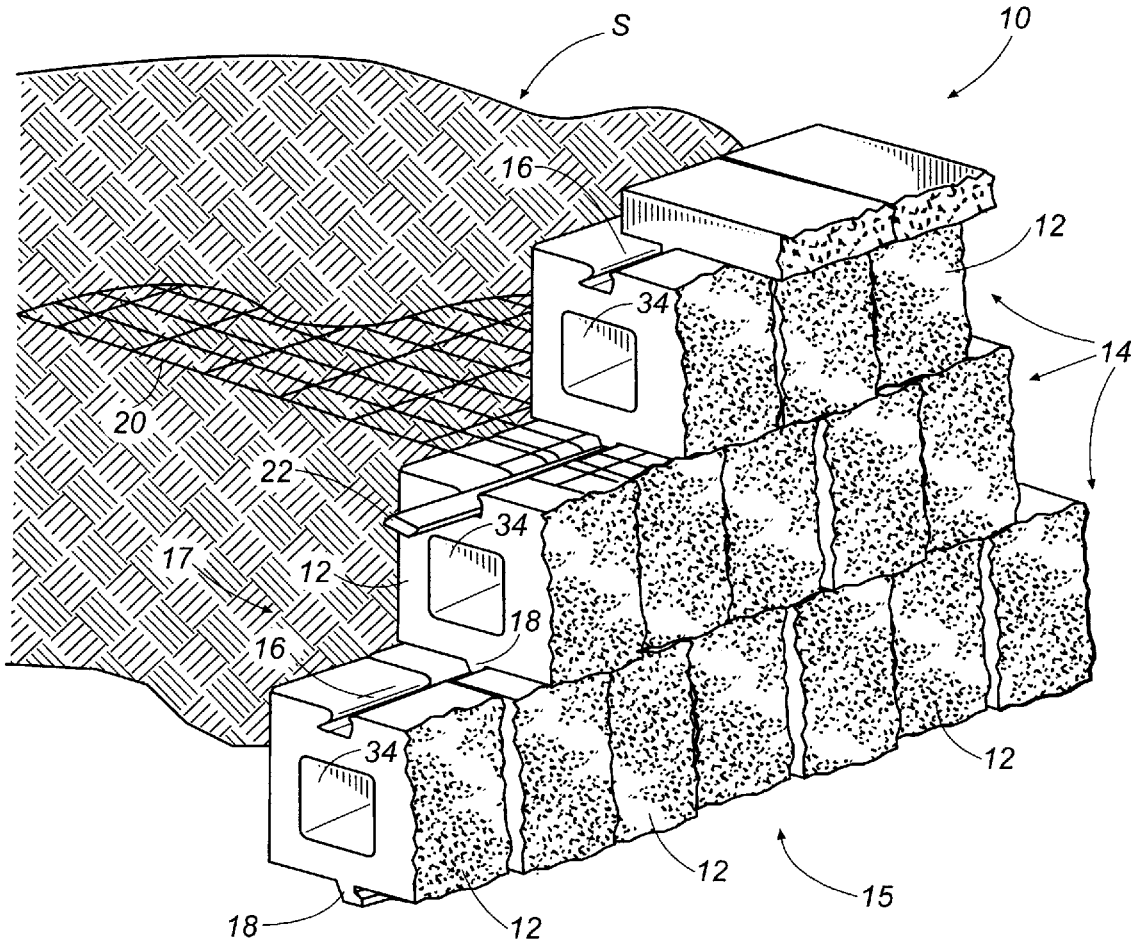
FIG. 1 is a perspective view of a retaining wall formed in accordance with the present invention.

Referring now in more detail to the drawings, in which like numerals indicate like parts throughout the several views, FIG. 1 illustrates the general concept of a modular retaining wall 10 constructed in accordance with the present invention. As depicted in this figure, the retaining wall comprises a plurality of wall blocks 12 that are stacked atop each other in ascending courses 14. When stacked in this manner, the wall blocks together form an exterior surface 15 which faces outwardly away from the soil, and an interior surface 17 which faces inwardly toward the soil.

Generally speaking, the blocks 12 are substantially identical in size and shape for ease of block fabrication and wall construction. Accordingly, each block is provided with a lock channel 16 and a lock flange 18 that are configured so as to mate with each other when the blocks are stacked atop one another to form the retaining wall 10. When the blocks are aligned side-by-side within each course as shown in FIG. 1, the lock channels 16 form a continuous lock channel that extends the length of the lower of the mating courses. Similarly, the lock flanges form a continuous lock flange that extends the length of the upper of the mating courses. Accordingly, the blocks can be stacked in a staggered arrangement as shown in FIG. 1 to provide greater stability to the wall. In addition to providing for correct alignment of the blocks of each course, the lock channels and lock flanges preclude forward leaning or toppling of the blocks. Therefore, the lock channels and lock flanges serve as integral locking means for positively locking the blocks together.

Positioned between two mating courses of wall blocks is a reinforcement member 20. The reinforcement member is of known construction and typically extends from the exterior surface 15 of the retaining wall 10 and into the backfill soil S. Specifically, the reinforcement member extends from the exterior surface 15, into the lock channel 16, and past the interior surface 17 of the retaining wall to extend into the soil. Placed on top of the reinforcement member in the lock channel 16 is a retaining bar 22. This retaining bar secures the reinforcement member in place between the courses of the retaining wall and therefore forms part of retaining means for securing the reinforcement member in place with respect to the retaining wall. In that a continuous lock channel is formed by the blocks, a single elongated retaining bar can be used. However, it will be understood that several shorter retaining bars could be used if desired.

Figure 2:
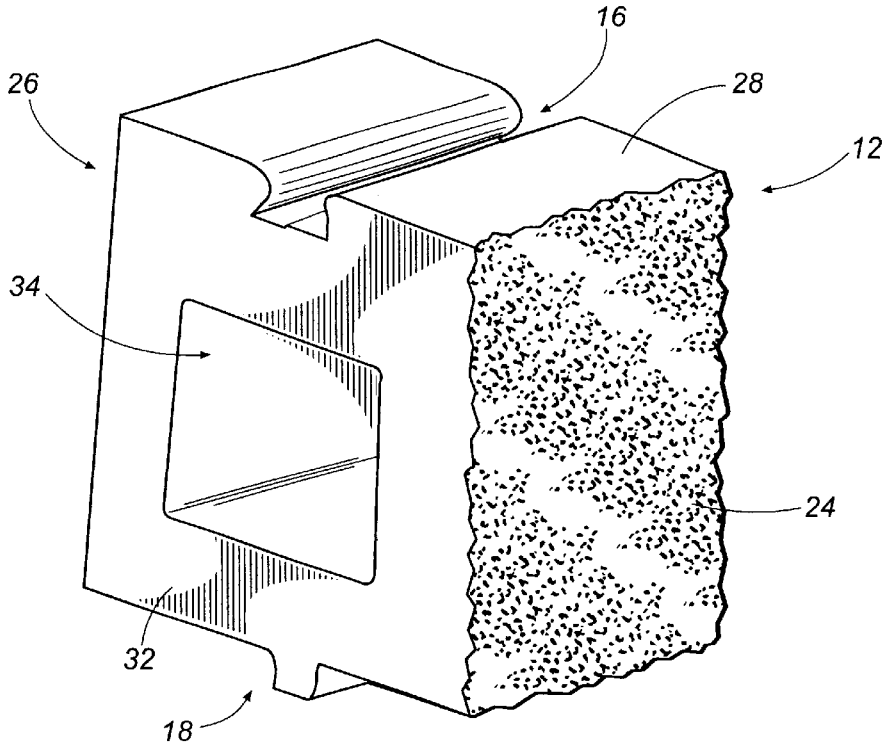
FIG. 2 is a perspective front view of a wall block used in the present system.
Figure 3:
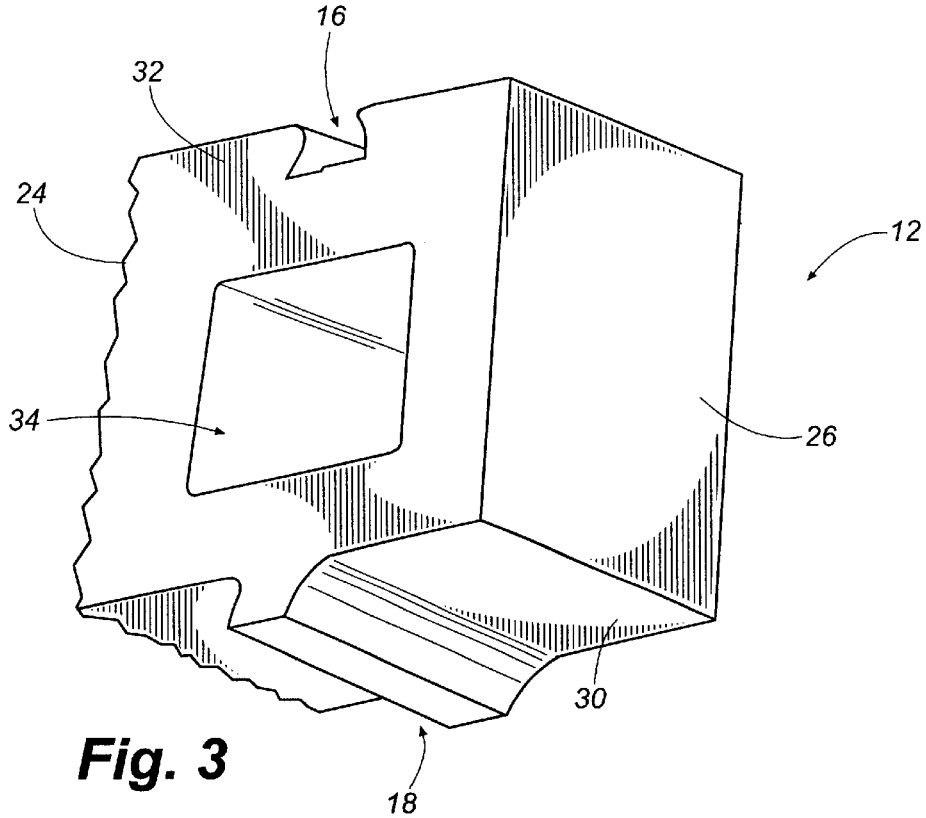
FIG. 3 is a perspective rear view of the wall block shown in FIG. 2.

Having generally described type of retaining wall that can be constructed in accordance with the present disclosure, a detailed description of the wall blocks will now be provided. Referring to FIGS. 2 and 3, each wall block 12 comprises an exterior face 24, an opposed interior face 26, a top surface 28, a bottom surface 30, and two opposed sides 32. As briefly identified above, the exterior faces of the blocks form the exterior surface of the retaining wall. Accordingly, the exterior faces are typically provided with an ornamental facing to create a visually pleasing facade. Also, the exterior face 24 of each wall block usually is sloped inwardly from the bottom surface 30 to the top surface 28 in an incline ratio of approximately 30 to 1. This inward slope creates an aggregate inward slope effect over the entire retaining wall which counteracts the outward leaning impression commonly created by such walls when viewed by the observer. Contrary to the exterior face, the interior faces 26 of the wall blocks are configured in an upright orientation and, therefore, form the upright interior surface of the retaining wall. Normally, the blocks are approximately 15 inches tall and 8 inches wide, although it will be appreciated that almost any size block can be formed in accordance with this disclosure.

The top and bottom surfaces 28 and 30 of each block are typically parallel to each other so that, when stacked on top of one another, an upright wall is formed. Similar to the interior faces 26, the opposed sides 32 are typically parallel to each other. However, the opposed sides can be inwardly tapered from the exterior face of the block to the interior face of the block to form curved walls of nearly any shape. Further provided in the wall blocks are interior openings 34. These openings reduce the amount of materials needed to fabricate the blocks and reduces the weight of the blocks to simplify wall construction.

Figure 4:
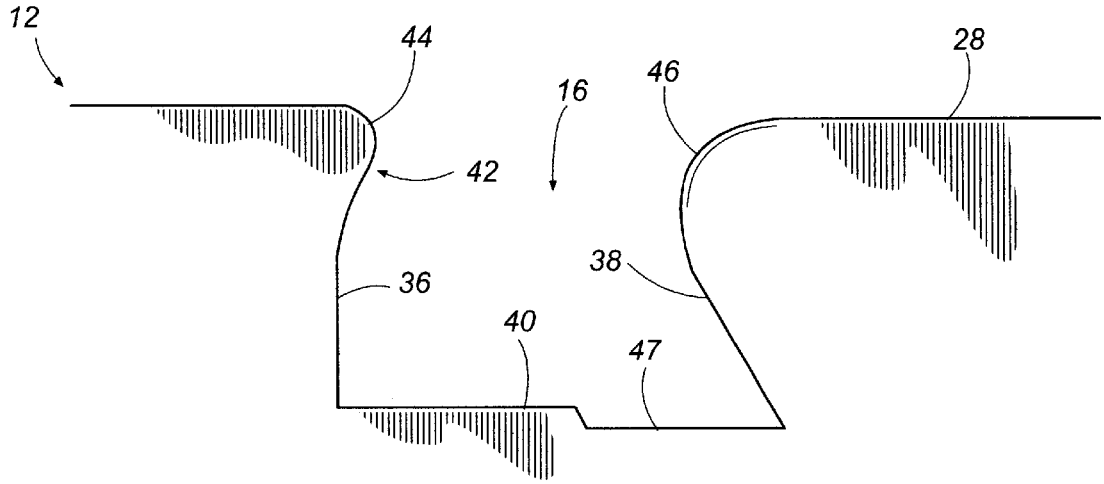
FIG. 4 is a detail view of a lock channel provided in a top surface of the wall blocks.

As described above, the top and bottom surfaces of each block are provided with a lock channel 16 and lock flange 18, respectively. Illustrated in FIG. 4, the lock channel 16 is defined by a front wall 36, a rear wall 38, and a channel bottom surface 40 and extends transversely across the top surface 28 of each wall block. The front wall forms a frontal lip 42 that extends obliquely toward the interior face 26 of the wall block 12. As indicated in the figure, the oblique extension of the frontal lip begins at a point approximately halfway along the height of the front wall 36. The lip is normally curved such that a first substantially arcuate edge 44 of the channel is formed. Positioned opposite the front wall, the rear wall 38 of the lock channel 16 extends obliquely toward the exterior face 24 of the wall block 12. Like the front wall, an upper extent of the rear wall is curved so as to form a second substantially arcuate edge 46 of the lock channel. Provided the channel bottom surface 40 is a longitudinal notch 47. This notch typically extends the full length of the lock channel and, as will be described below, facilitates insertion of a reinforcement member retaining bar.

Figure 5:
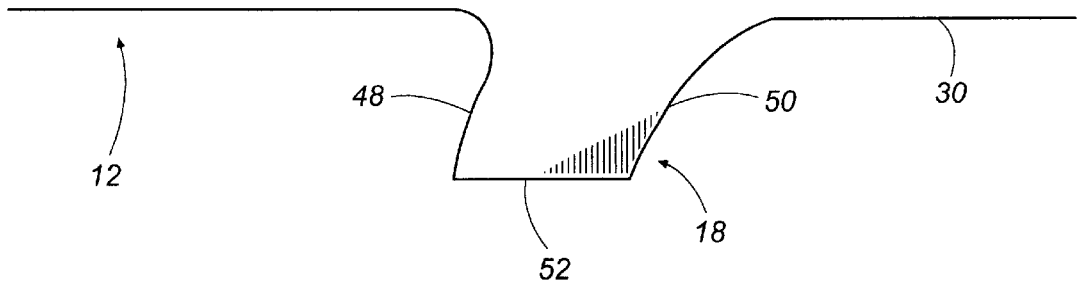
FIG. 5 is a detail view of a lock flange provided on a bottom surface of the wall blocks.

Illustrated in FIG. 5 is the lock flange 18. As indicated in this figure, the lock flange is defined by a front surface 48, a rear surface 50, and a top surface 52 and the flange extends transversely across the bottom surface 30 of the wall block. Similar to the rear wall 38 of the lock channel, both the front surface 48 and the rear surface 50 extend obliquely toward the exterior face 24 of the wall block 12 such that the lock flange 18 itself extends obliquely towards the exterior face 24 of the block. To provide for the locking function noted above, the front surface 48 of the block is specifically sized and shaped for mating engagement to the front wall 36 of the lock channel 16. Accordingly, during wall construction, the wall blocks can be placed on top of lower wall blocks such that the lock flanges extend into the lock channels. Once so situated, the upper wall blocks can be slid forward along the lower blocks so that the front surfaces 48 of the lock flanges 18 abut the front walls 36 of the lock channels. As will be described below, it is this abutment that prevents the block from leaning forward or toppling.

Although capable of alternative construction, the wall blocks 12 are preferably formed of pre-cast concrete. As is known in the art, the blocks are commonly mixed in a hatching plant in a high-speed process. Cement, aggregate, and water are mixed in a hopper to form a concrete mixture which is poured into a mold box to form the blocks. To increase block output of this process and simplify the block forming process, typically a multiple block mold is used. In particular, the mold is configured to form one continuous piece from which several blocks will be made. Once the piece is formed, the individual blocks are separated from the extended piece with a splitter that slices through the piece. In this manner, the number of mold fillings and compactions per block is reduced, increasing fabrication productivity. This splitter also typically gives the exterior face of the block a rough split-stone appearance.

Figure 6:
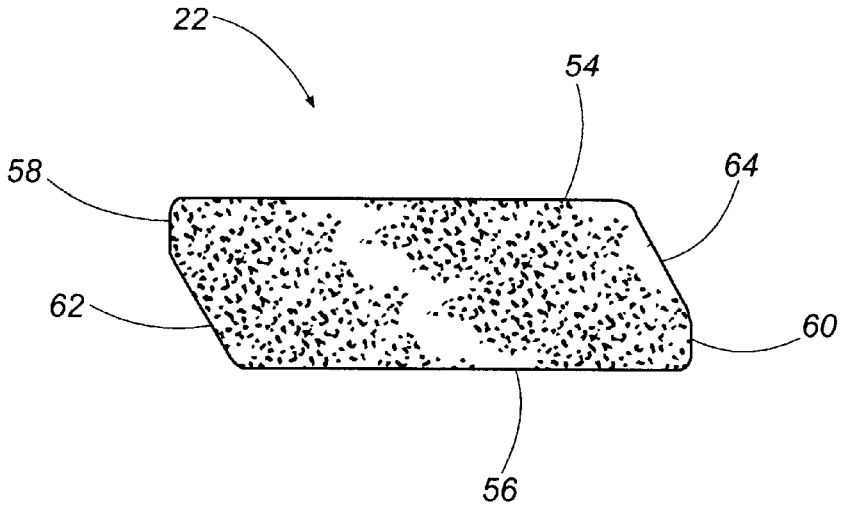
FIG. 6 is a side view of a reinforcement member retaining bar used in the present system.
Figure 7:
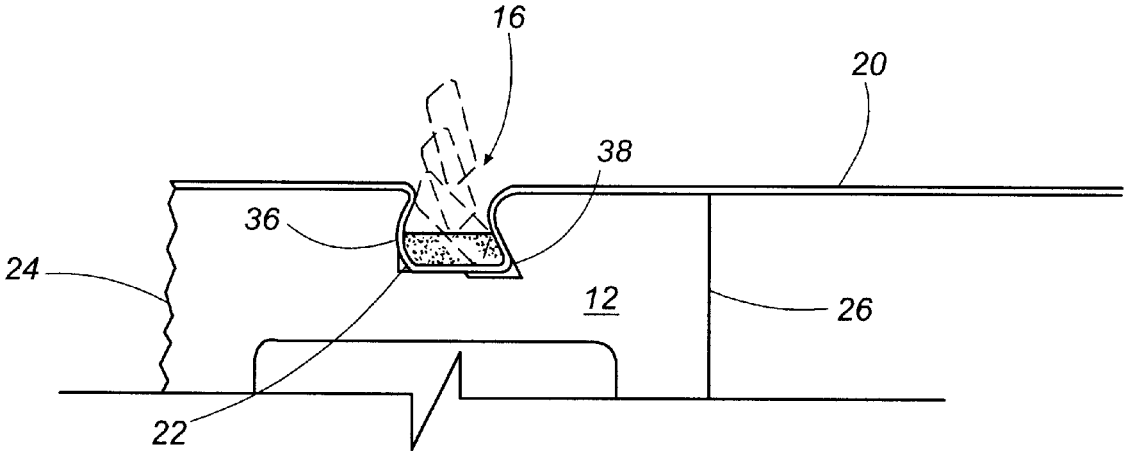
FIG. 7 is a partial side view of a wall block depicting insertion of a retaining bar over a reinforcement member within a lock channel of the wall block.

The reinforcement member retaining bar 22, shown most clearly in FIG. 6, is specifically shaped and configured to fit within the lock channel 16. In a preferred arrangement, the retaining bar 22 has six different surfaces: a top surface 54, a bottom surface 56, a first upright surface 58, a second upright surface 60, a first oblique surface 62, and a second oblique surface 64. Normally, the top surface and the bottom surface are parallel to each other as are the first oblique surface and the second oblique surface. Similarly, the first upright surface and the second upright surface are typically parallel to each other such that the first upright surface extends perpendicularly from the upper surface and the second upright surface extends perpendicularly from the bottom surface. Configured in this manner, the retaining bar can be positioned on top of a reinforcement member 20 in the lock channels 16 by inserting the retaining bar into the channels with the second upright surface 60 forward, and twisting the bar downward into place as depicted in FIG. 7. In that the bar is designed to fit closely between the front and rear walls of the channels when in place, the longitudinal notch 46 provides a void that accommodates the second upright surface to facilitate the twisting and downward insertion of the bar.

Once correctly inserted within the lock channel, the first upright surface 58 and the second oblique surface 64 of the retaining bar hold the reinforcement member 20 against the front and rear walls of the channel, respectively, as shown in FIG. 7. So disposed, the retaining bar prevents the reinforcement member from being pulled out from the retaining wall. Specifically, when a tensile force is applied to the reinforcement member from the soil side of the retaining wall, the retaining bar is urged towards the interior surface of the retaining wall, causing the second oblique surface 64 to press the reinforcement member against the rear wall 38 of the channel, locking it in place. In that the amount of pressure that must be applied by the retaining bar is not large, the retaining bar can be constructed of a polymeric material such as nylon 66 or high density polyethylene. Usage of such polymers provides the additional advantages of being lightweight and therefore easy to manipulate, and chemically inert and therefore resistant to corrosion.

Several different types of reinforcement members are currently available. For example, both metal and polymeric geogrids are in manufacture. In the present system, however, the selected reinforcement member must be adequately flexible to permit insertion of the reinforcement member into the lock channel and subsequent insertion of the retaining bar. Furthermore, the selected reinforcement member, like the retaining bar, should be constructed of an inert material which will resist rusting or other corrosion. Accordingly, it is preferred that the reinforcement member comprise a flexible fabric composed of a polymeric material such as polypropylene or high tenacity polyester.

Figure 8:
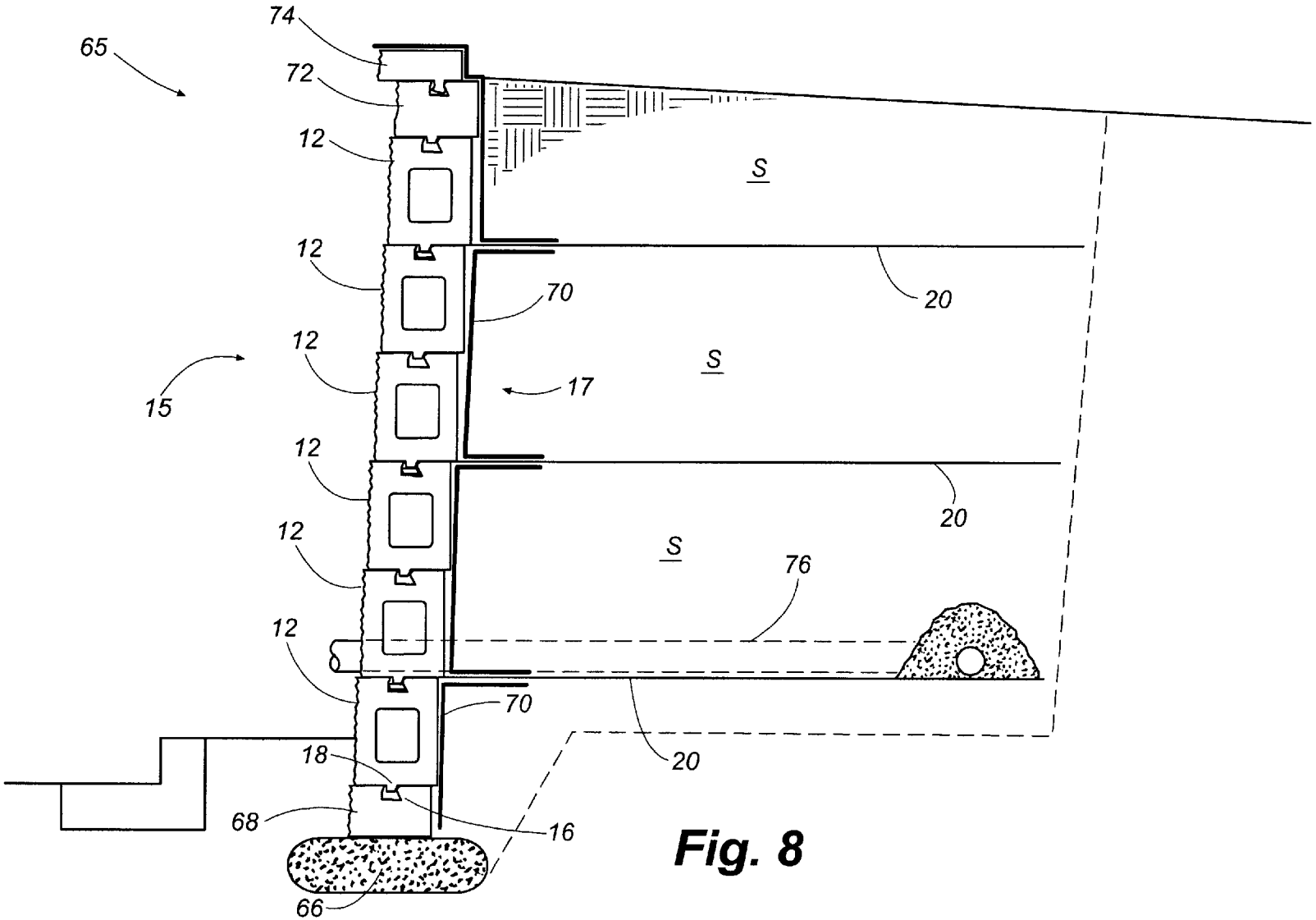
FIG. 8 is a cross-sectional view of an example retaining wall constructed in accordance with the present invention.

The system of the present invention can be used to construct any number of different configurations of modular retaining walls. FIG. 8 illustrates one example of such a retaining wall 64. To construct such a wall, a leveling pad 66 is laid to provide a foundation upon which to build the wall. Typically, this leveling pad comprises a layer of compacted crushed stone that is embedded under the soil to protect the wall foundation. Once the leveling pad is laid and compacted, a plurality of starting blocks 68 are aligned along the length of the pad. Each of the starting blocks is provided with a locking channel in its top surface. However, since there are no lower courses with which to engage, the starter blocks are not provided with lock flanges. Additionally, the starting blocks are only approximately half as tall as the wall blocks and are therefore approximately 7.5 inches in height. Although such starting blocks are typically used in the starting course of the retaining wall, it is to be noted that the standard wall blocks 12 could be used to form this course if a groove is provided in the leveling pad to accommodate the lock flanges of the blocks. As is evident from FIG. 8, the starting course of the wall is normally embedded underground along with the leveling pad.

After the starting course has been formed with either the starting blocks 68 or wall blocks 12, the next course of blocks can be laid. The wall blocks are placed on top of the blocks of the starting course with the lock flanges 18 of each block extending into the lock channels 16 of the lower blocks. Once so positioned, the upper blocks are slid forward along the lower blocks until the lock flanges engage the front walls 36 of the lock channels 16 provided in the lower blocks. As can be appreciated from FIG. 8 and with reference to FIGS. 4 and 5, the front surfaces 48 of the lock flanges mate with the frontal lips 42 of the lock channels such that each lock flange 18 extends underneath the frontal lips. This mating relationship holds the wall block in place atop the lower block and prevents it from tipping forward, thereby providing integral locking means for the block.

Once the first wall course has been formed atop the starting course, backfill soil S can be poured into place behind the blocks. Typically, a non-woven filter fabric 70 is provided between the wall and the backfill soil to prevent the introduction of particulate matter between the courses of blocks due to water migration within the soil. Alternatively, a layer of gravel aggregate can be provided between the wall and the soil to serve the same function.

Figure 9:
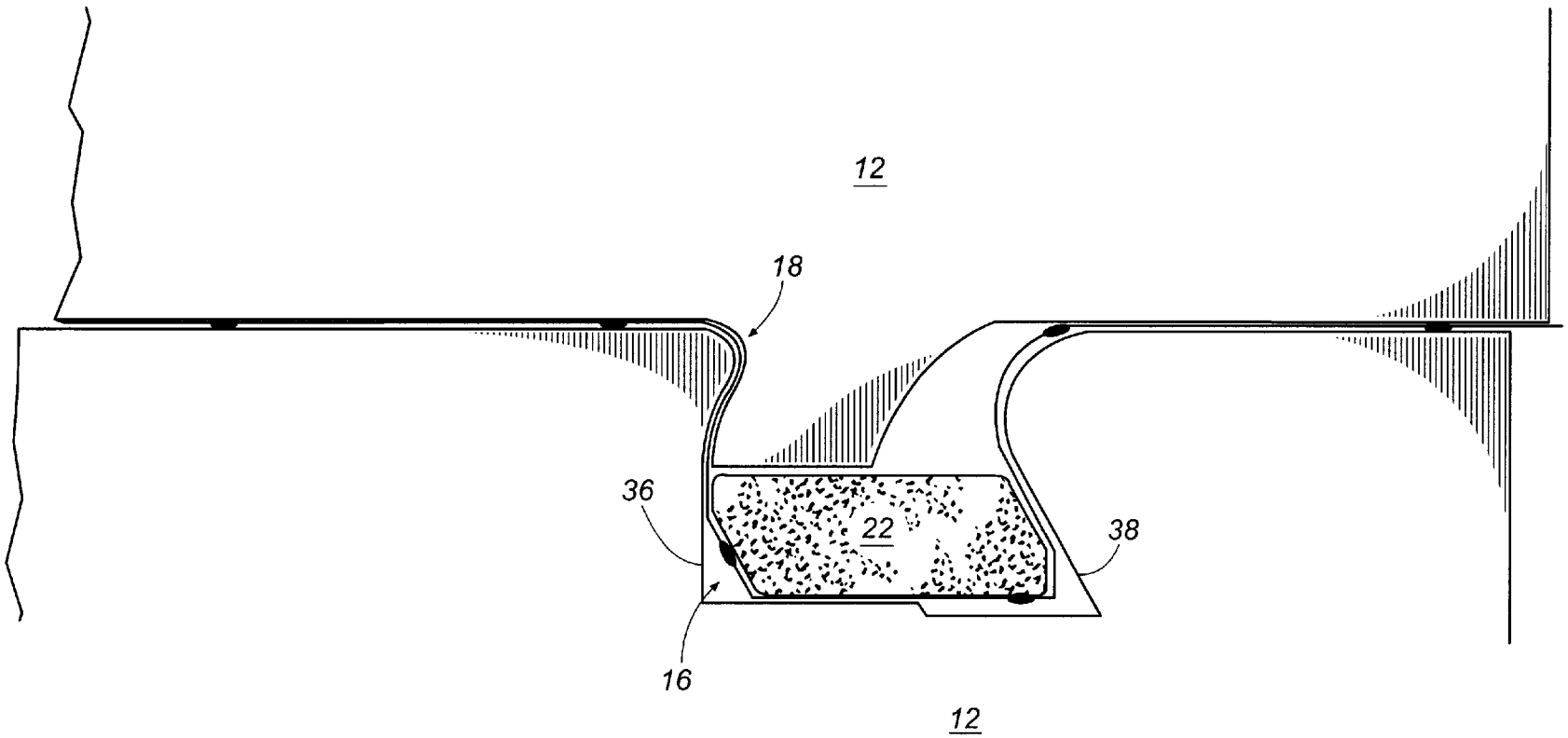
FIG. 9 is a detail view showing the retention of a reinforcement member between adjacent stacked wall blocks.

Additional ascending courses are thereafter laid in the manner described above. Although alternative configurations are possible, a reinforcement member is typically laid between every other course of blocks as indicated in FIG. 8. It will be appreciated, however, that more or fewer reinforcement members can be provided depending upon the particular reinforcement needs of the construction site. Preferably, these reinforcement members 20 are composed of a flexible polymeric fabric. As described above, the reinforcement member is positioned so that it will extend from the exterior surface 15 of the retaining wall, into the lock channel 16, and past the exterior surface 17 of the retaining wall to extend into the soil. As shown most clearly in FIG. 9, a reinforcement member retaining bar 22 is placed on top of the reinforcement member 20 in the lock channel 16. When the next course of blocks 12 is laid on top of the lower course, the lock flange 18 of the upper blocks will extend into the lock channel 16 and will be positioned adjacent the retaining bar.

Construction of the retaining wall 65 continues until the desired height is attained. As indicated in FIG. 8, the inward slope of the wall blocks creates a net inward slope of the retaining wall. Additionally, the configuration the blocks creates an aesthetically pleasing stepped appearance for the exterior surface of the wall. Where the full height of a wall block 12 is unnecessary or not desired, short wall blocks 74 can be used to form the top course. Typically, these short wall blocks are approximately 7.5 inches in height, one half the height of the standard wall blocks 12. Once the retaining wall has been raised to the required height, cap blocks 72 can be used to complete the wall. As shown in FIG. 8, these cap blocks 74 are provided with a lock flange, but do not have an upper lock channel in that further construction will not be conducted. Normally, the cap blocks are fixed in position with concrete adhesive and the top surface of the cap blocks are provided with an ornamental pattern similar to the exterior faces of the blocks. The cap block is designed to extend out over the lower block to provide a lip for aesthetics. Additionally, a subsurface collector drain 76 can be provided within the backfill soil to remove excess water collected therein.

While preferred embodiments of the invention have been disclosed in detail in the foregoing description and drawings, it will be understood by those skilled in the art that variations and modifications thereof can be made without departing from the spirit and scope of the invention as set forth in the following claims. For instance, as briefly referenced above, the sides of the blocks can be tapered inwardly to form a curved wall. As will be appreciated by those having skill in the art, when such a curved wall is constructed, the reinforcement member retaining bar will likewise need to be curved or angled if the builder wishes to extend reinforcement members from the blocks of the curved portions of the wall.

What is claimed is:

1. An elongated retaining bar for securing a reinforcement member to a modular retaining wall comprised of a plurality of retaining wall blocks having transverse channels which align to form an elongated channel when the blocks are arranged in a course of the retaining wall, said retaining bar comprising:

a top surface;

a bottom surface formed opposite said top surface;

a front surface; and a rear surface formed opposite said front surface;

wherein said retaining bar is sized and configured to have a width dimension that is greater than the width of an opening of the elongated channel through which said retaining bar is adapted to pass but smaller than the width dimension of a base of the elongated channel such that when said retaining bar has been inserted into the elongated channel through the opening and over the reinforcement member, said retaining bar clamps the reinforcement member within the elongated channel when a tensile force is applied to the reinforcement member.

2. The retaining bar of claim 1, wherein said retaining bar is substantially rectilinear in cross-section.

3. The retaining bar of claim 1, wherein said top surface is substantially planar.

4. The retaining bar of claim 1, wherein said front surface extends substantially perpendicularly downward from said top surface.

5. The retaining bar of claim 1, wherein said rear surface extends obliquely downward from said top surface.

6. The retaining bar of claim 1, further comprising an oblique surface extending from said front surface to said bottom surface.

7. The retaining bar of claim 1, further comprising a surface extending substantially perpendicularly upward from said bottom surface and connecting to said rear surface.

8. The retaining bar of claim 1, wherein said retaining bar is made of a polymeric material.

9. The retaining bar of claim 1, wherein said retaining bar is solid in cross-section.

10. An elongated retaining bar for securing a reinforcement member to a modular retaining wall, said retaining bar comprising:

a substantially planar top surface;

a bottom surface formed opposite said top surface;

a front surface extending substantially perpendicularly downward from said top surface; and a rear surface extending obliquely from said top surface;

wherein said retaining bar is adapted to be inserted through the top of an elongated channel formed along the upper surface of a course of the modular retaining wall and positioned therein.

11. The retaining bar of claim 10, further comprising an oblique surface extending from said front surface to said bottom surface.

12. The retaining bar of claim 10, further comprising a surface extending substantially perpendicularly upward from said bottom surface and connecting to said rear surface.

13. The retaining bar of claim 10, wherein said retaining bar is made of a polymeric material.

14. The retaining bar of claim 10, wherein said retaining bar is solid in cross-section.

15. An elongated retaining bar for securing reinforcement members to a modular retaining wall, said retaining bar comprising:

a substantially planar top surface;

a substantially planar bottom surface;

a first upright surface extending perpendicularly from said top surface;

a second upright surface extending perpendicularly from said bottom surface;

a first oblique surface extending from said bottom surface to said first upright surface; and a second oblique surface extending from said top surface to said second upright surface;

wherein said retaining bar is adapted to be inserted through the top of an elongated channel formed along the upper surface of a course of the modular retaining wall and positioned therein.

16. The retaining bar of claim 15, wherein said first oblique surface and said second oblique surface are substantially parallel to each other.

17. The retaining bar of claim 15, wherein said top and said bottom surfaces are substantially parallel to each other.

18. The retaining bar of claim 15, wherein said oblique surfaces are approximately three times as wide as said upright surfaces.

19. The retaining bar of claim 15, wherein said retaining bar is made of a polymeric material.

20. The retaining bar of claim 15, wherein said retaining bar is solid in cross-section.

21. A reinforcement member retaining system, comprising:

an elongated channel formed within a course of a retaining wall, said elongated channel being adapted to receive a reinforcement member and having an opening and a base, the width dimension of said opening being greater than the width dimension of said base; and an elongated retaining bar configured to be disposed within said elongated channel, said elongated retaining bar having a top surface, a bottom surface, a front surface and a rear surface, said retaining bar having a width dimension which is greater than the width dimension of said elongated channel opening but smaller than the width dimension of said elongated channel base;

wherein said elongated retaining bar is insertable within said elongated channel by passing said elongated retaining bar through said elongated channel opening while rotating said elongated retaining bar, said retaining bar clamping the reinforcement member within said elongated channel when a tensile force is applied to the reinforcement member.

22. The system of claim 21, wherein said retaining bar is substantially rectilinear in cross-section.

23. The system of claim 21, wherein said top surface is substantially planar.

24. The system of claim 21, wherein said front surface extends substantially perpendicularly downward from said top surface.

25. The system of claim 21, wherein said rear surface extends obliquely downward from said top surface.

26. The system of claim 21, further comprising an oblique surface extending from said front surface to said bottom surface.

27. The system of claim 21, further comprising a surface extending substantially perpendicularly upward from said bottom surface and connecting to said rear surface.

28. The system of claim 21, wherein said retaining bar is made of a polymeric material.

29. The system of claim 21, wherein said retaining bar is solid in cross-section.

30. A method for retaining a reinforcement member within a modular retaining wall, comprising:

forming an elongated channel in at least one course of the retaining wall, the elongated channel being adapted to receive the reinforcement member and having an opening and a base, the width dimension of said opening being greater than the width dimension of said base;

laying the reinforcement member over the course such that it extends into the elongated channel; and inserting an elongated retaining bar within the elongated channel over the reinforcement member, the elongated retaining bar having a width dimension which is greater than the width dimension of the elongated channel opening but smaller than the width dimension of the elongated channel base such that the retaining bar clamps the reinforcement member within the elongated channel when a tensile force is applied to the reinforcement member.

31. An elongated retaining bar for securing a reinforcement member to a retaining wall block having a transverse channel formed in a surface thereof, the channel comprising opposed first and second channel walls and a channel base, where the channel walls each extend from the channel base to the block surface so that the channel is open to the block surface in which it is formed and extends from one side of the block to the opposed side of the block, where the length of the channel from one side of the block to the other side of the block is greater than the width of the channel from the first channel wall to the second channel wall at the block surface, and where, at a first level in the channel, the width of the channel is less than it is at a second level closer to the channel base, said retaining bar comprising:

opposed first and second ends;

a top surface;

a bottom surface formed opposite said top surface;

a front surface; and a rear surface formed opposite said front surface;

wherein the length of said bar from end to end is greater than the largest distance between said front and rear surfaces, and the length of said bar from end to end is greater than the largest distance between said top and bottom surfaces, and wherein said retaining bar is sized and configured so that it may be inserted into the channel through the opening of the channel to the block surface in which the channel is formed and may then be rotated so that said front surface of said bar is located adjacent the first channel wall and said rear surface of said bar is located adjacent the second channel wall, and said top surface of said bar is located at a level in the channel that is closer to the channel base than the first channel level, so that, when a sheet of geosynthetic reinforcement material is laid across the channel opening and said retaining bar is then inserted into the channel and rotated, said retaining bar clamps the sheet of reinforcement material within the elongated channel when a tensile force is applied to the reinforcement member.

* * * * *

UNITED STATES PATENT AND TRADEMARK OFFICE

CERTIFICATE OF CORRECTION

PATENT NO. : 6,322,291 B1
DATED : November 27, 2001
INVENTOR(S) : Thomas L. Rainey It is certified that error appears in the above-identified patent and that said Letters Patent is hereby corrected as shown below:

Column 4,
Line 51, after "Provided" insert -- in --

Column 6,
Line 12, delete "64" and replace it with -- 65 --

Column 9,
Line 7, delete "greater" and replace it with -- less --
Line 47, delete "greater" and replace it with -- less --

Signed and Sealed this

Twenty-third Day of April, 2002

*Attest:*

*Attesting Officer*

JAMES E. ROGAN
*Director of the United States Patent and Trademark Office*